US008632347B2

(12) United States Patent
Chen et al.

(10) Patent No.: US 8,632,347 B2
(45) Date of Patent: Jan. 21, 2014

(54) SAFETY SOCKET WITH PROTECTIVE DOOR

(75) Inventors: Jinguo Chen, Ningbo (CN); Haiping Zhu, Ningbo (CN)

(73) Assignee: Ningbo KML Electrical Co., Ltd., Ningbo, Zhejiang Province (CN)

( * ) Notice: Subject to any disclaimer, the term of this patent is extended or adjusted under 35 U.S.C. 154(b) by 0 days.

(21) Appl. No.: 13/558,688

(22) Filed: Jul. 26, 2012

(65) Prior Publication Data

US 2013/0189864 A1 Jul. 25, 2013

(30) Foreign Application Priority Data

Jan. 17, 2012 (CN) ..... 2012 1 00130754

(51) Int. Cl.
*H01R 13/453* (2006.01)

(52) U.S. Cl.
USPC ..... 439/137; 439/145

(58) Field of Classification Search
USPC ..... 439/137, 145
See application file for complete search history.

(56) References Cited

U.S. PATENT DOCUMENTS

| | | | | |
|---|---|---|---|---|
| 4,722,693 | A * | 2/1988 | Rose | 439/137 |
| 7,820,909 | B2 * | 10/2010 | Castaldo et al. | 174/53 |
| 7,914,307 | B1 * | 3/2011 | Yang | 439/137 |
| 7,942,681 | B2 * | 5/2011 | Ni | 439/137 |
| 7,985,085 | B2 * | 7/2011 | Gao | 439/137 |
| 8,242,362 | B2 * | 8/2012 | Castaldo et al. | 174/53 |
| 2009/0311892 | A1 * | 12/2009 | Weeks | 439/137 |
| 2010/0041259 | A1 * | 2/2010 | Ni | 439/137 |
| 2011/0092086 | A1 * | 4/2011 | Gao | 439/137 |
| 2013/0189864 | A1 * | 7/2013 | Chen et al. | 439/136 |

* cited by examiner

*Primary Examiner* — James Harvey
(74) *Attorney, Agent, or Firm* — Jacobson Holman PLLC; Jiwen Chen

(57) ABSTRACT

The invention discloses a safety socket with protective door comprising a socket panel, a reset spring, a protective door, and a protective door casing installed on the socket panel, wherein the socket panel and the protective door casing are provided with jacks, a partition is arranged inside the protective door casing, the protective door is provided with a through cavity and sleeved on the partition, the reset spring is located in the through cavity and between the partition and the protective door, slopes are arranged on the inner walls of the protective door, two bottom inclined walls are arranged on the lower end of the protective door, a fulcrum is formed at the intersection of the two bottom inclined walls, and limiting lug bosses matched with the jacks on the protective door casing are arranged on the left and right lower ends of the protective door, respectively.

6 Claims, 5 Drawing Sheets

SAFETY SOCKET WITH PROTECTIVE DOOR

The present application claims the priority of Chinese Application No. 2012100130754, filed Jan. 17, 2012 under 35 U.S.C. §119, which is hereby incorporated by reference.

TECHNICAL FIELD

The present invention relates to a socket, specifically to a safety socket with a protective door.

BACKGROUND

In general, no protective door is installed in the current common sockets on the market, namely, jacks are typically exposed. There will be the danger of electric shock if a metal foreign substance, e.g. a key, is inserted into jacks by children.

Some sockets with protective door have been commercially available to avoid this kind of dangerous accident, and jacks are opened by poking manually when these sockets are in use and are covered when not in use, so unsafe factors still exist; and in some other sockets with protective doors, the protective door opens or closes the jacks only by means of a spring-pushing elastic force because the protective door has no limiting function. As a result, the insertion of foreign impurities into single jack cannot be prevented effectively, which also causes potential danger.

SUMMARY OF THE INVENTION

The technical problem to be solved by the present invention is to provide a safety socket with a protective door, which is featured by shaded jacks when not in use, has no visible and exposed conductive coppers, and can effectively prevent the insertion of foreign substances into one jack to result in accident.

In order to solve the technical problem above, such a safety socket with a protective door is adopted in the present invention, which comprises a socket panel, a reset spring, a protective door, and a protective door casing installed on the socket panel; the socket panel and the protective door casing are provided with jacks that are used together therewith, a partition is arranged inside the protective door casing, the protective door is provided with a through cavity and sleeved on the partition, the reset spring is located in the through cavity, one end of the reset spring abuts against the partition while the other end of the reset spring abuts against the right inner wall of the protective door, slopes for the insertion of a plug are arranged on the left and right inner walls of the protective door, two bottom inclined walls that are inclined upwards from middle to two ends are arranged on the lower end of the protective door, a fulcrum for vertical swing of the protective door is formed at the intersection of the two bottom inclined walls, and limiting lug bosses matched with the jacks on the protective door casing are arranged on the left and right lower ends of the protective door, respectively.

The right side of the partition and the right inner wall of the protective door are respectively provided with installation bases for the reset spring to be sleeved.

The upper end of the protective door is also provided with two top inclined walls that are inclined downwards from middle to two ends, and an upper fulcrum for vertical swing of the protective door is formed at the intersection of the two top inclined walls.

The left and right upper ends of the protective door are respectively provided with upper limiting lug bosses matched with the jacks on the socket panel.

The protective door casing is further provided with a copper installation frame for conductive copper installation.

The protective door casing is further equipped with a protective door cover plate for preventing the reset spring from springing out in the process of assembly, and the protective door cover plate is also provided with jacks that are used together with the socket panel and the protective door casing.

Compared with the prior art, the present invention has the following advantages: the safety socket with protective door in the invention can realize the contact-type electric conduction between pins and conductive coppers in the socket only when the pins are inserted into the two jacks uniformly and evenly, that is to say, the protective door is evenly stressed to complete transition to one side when a plug is inserted; and in the case that the pin is inserted into only one jack, the protective door will just swing about its fulcrum owing to uneven stress on its two sides, thus preventing the insertion of the pin into the socket; and when the pins are pulled out, the protective door will reset under the action of the spring to shade the conductive coppers in the socket. Therefore, the accident caused by the entrance of foreign substances into the socket is effectively avoided. To conclude, the safety socket with protective door in the invention not only has the function of preventing the insertion of one pin, but also plays a role of shading, so the purpose of safety protection is achieved.

As an improvement, the partition and the right inner wall of the protective door are respectively provided with installation bases for the reset spring to be sleeved; the locating effect is good and the possibility of springing out is low after the two ends of the reset spring are sleeved on the installation bases.

As a further improvement, the upper end of the protective door is also provided with two top inclined walls that are inclined downwards from middle to two ends, and an upper fulcrum for vertical swing of the protective door is formed at the intersection of the two top inclined walls; the protective door is easier to swing vertically after the upper fulcrum is used together with the fulcrum on the lower end of the protective door.

As a further improvement, the left and right upper ends of the protective door are respectively provided with upper limiting lug bosses matched with the jacks on the socket panel; the limiting reliability of the protective door is improved after the upper limiting lug bosses are used together with the limiting lug boss on the lower end of the protective door.

As a further improvement, the protective door casing is further provided with a copper installation frame for conductive copper installation, in this way, the coppers can be installed on the protective door casing to realize full use of the installation space and lead to more compact overall structure.

As a further improvement, the protective door casing is further equipped with a protective door cover plate for preventing the reset spring from springing out in the process of assembly, and the protective door cover plate is also provided with jacks that are used together with the socket panel and the protective door casing; on one hand, the arrangement of the protective door cover plate could prevent the reset spring from springing out effectively in the process of assembly so as to raise the working efficiency well; on the other hand, the jacks on the protective door cover plate could limit the protective door further.

Wherein: 1. socket panel, 1.1. installation column, 2. reset spring, 3. protective door, 3.1. through cavity, 3.2. slope, 3.3. two bottom inclined walls, 3.4. limiting lug boss, 3.5. two top inclined walls, 3.6. upper limiting lug boss, 4. protective door casing, 4.1. partition, 4.2. copper installation frame, 4.3. installation block, 4.4. lug boss, 4.5. installation column, 5. jack, 6. fulcrum, 7. installation base, 8. upper fulcrum, 9. protective door cover plate, 9.1. installation hole, 9.2. groove.

DETAILED DESCRIPTION OF THE EMBODIMENTS

Further description is made below to the invention with reference to the drawings and the embodiments.

Figure 1:
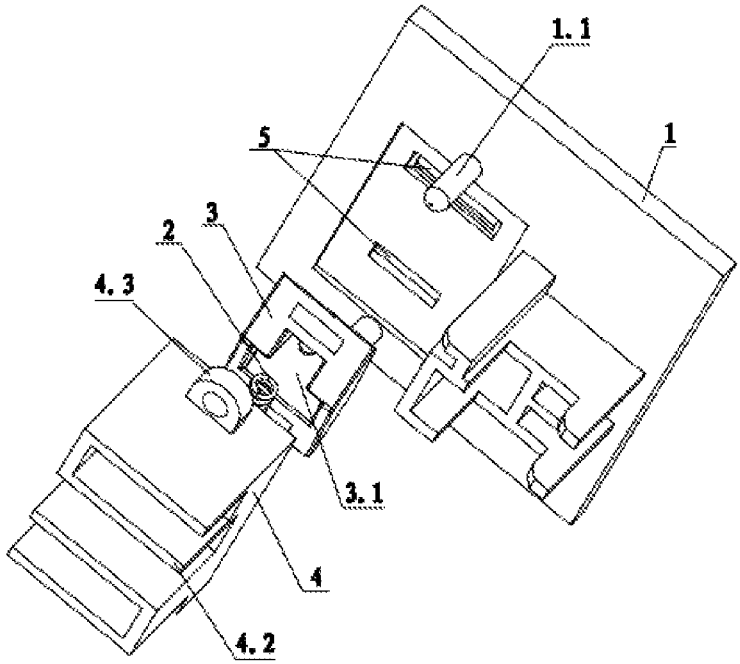
FIG. 1 is an exploded structural diagram of the first embodiment of the safety socket with protective door in the invention.
Figure 2:
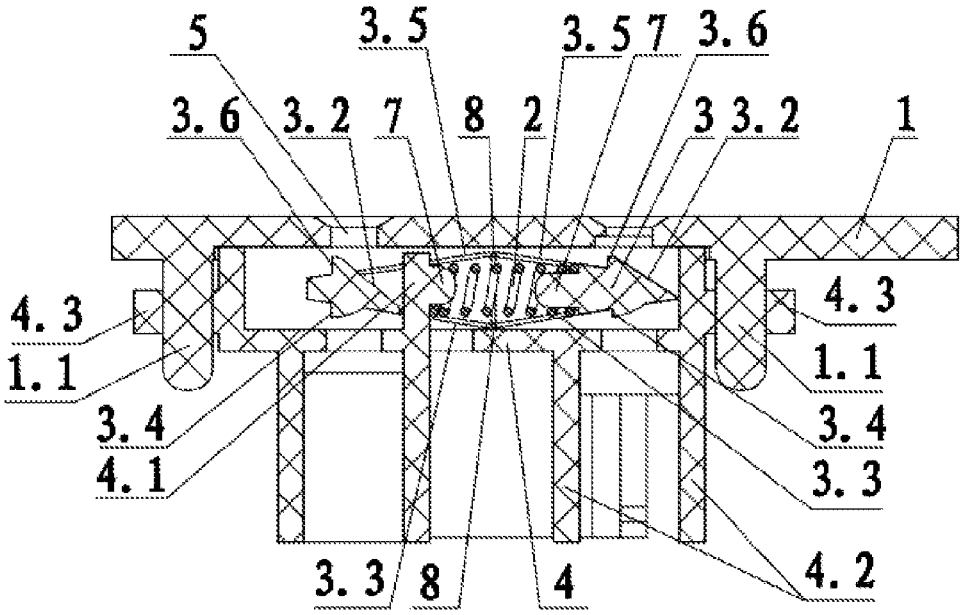
FIG. 2 is a sectional structural diagram of the first embodiment of the safety socket with protective door in the invention.
Figure 3:
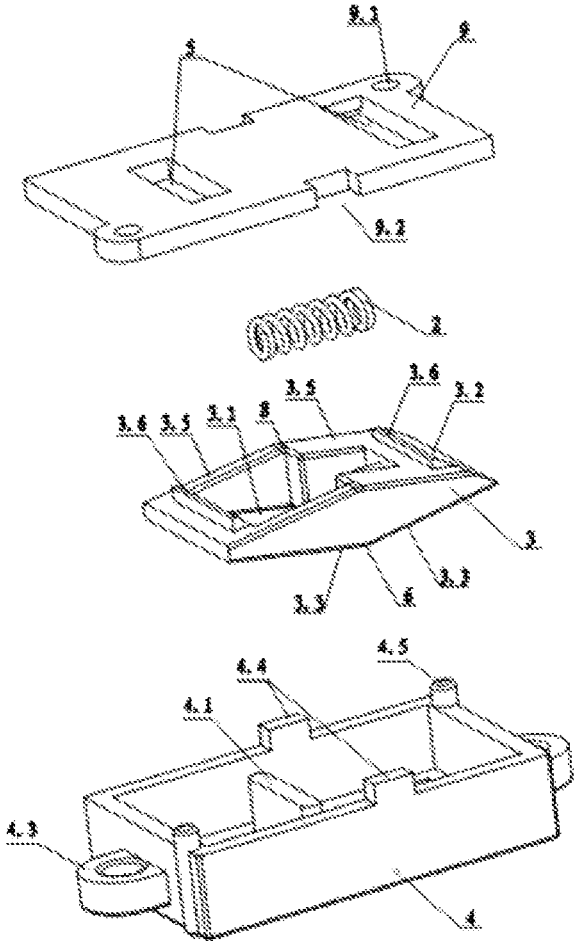
FIG. 3 is an exploded structural diagram of the second embodiment of the safety socket with protective door in the invention.

The first embodiment of the safety socket with protective door in the invention is shown as FIG. 1 and FIG. 2, the safety socket with protective door in this embodiment comprises a socket panel 1, a socket bottom casing (not shown), a protective door casing 4, a protective door 3 and a reset spring 2, and the protective door casing 4, the protective door 3 and the reset spring 2 are located between the socket panel 1 and the socket bottom casing. The protective door casing 4 is sleeved on an installation column 1.1 of the socket panel 1 through installation blocks 4.3 on the two ends. The top wall of the socket panel 1 and the bottom wall of the protective door casing 4 are provided with jacks that are used together therewith.

Referring to the up and down directions, the left and right directions and the front and rear directions shown as FIG. 2, the safety socket with protective door in the invention is technically characterized in that, a partition 4.1 is arranged inside the protective door casing 4, and the partition 4.1 is arranged on the bottom wall of the protective door casing 4 and near the jack at the left end of the protective door casing 4. The protective door 3 is provided with a through cavity 3.1 for accommodating the reset spring 2, the through cavity 3.1 passes through the upper and lower ends of the protective door 3 to form a hollow cavity, and the protective door 3 is sleeved on the partition 4.1 of the protective door casing 4. The reset spring 2 is located in the through cavity 3.1 of the protective door 3, and one end of the reset spring 2 is sleeved on an installation base 7 of the partition 4.1 while the other end thereof is sleeved on the installation base 7 at the inner side of the protective door 3 and abuts against the right inner wall of the protective door 3. Slopes 3.2 for the insertion of a plug are arranged on the left and right inner walls of the protective door, wherein the slope at the left inner wall of the protective door 3 is inclined downwards from left to right and the slope at the right inner wall of the protective door 3 is also inclined downwards from left to right, that is to say, the slope at the left inner wall of the protective door 3 and the slope at the right inner wall of the protective door 3 have the same inclination direction and grade of slope, and as an improvement of this embodiment, the slope at the left inner wall of the protective door 3 and the slope at the right inner wall of the protective door 3 have the same inclination angle. Two bottom inclined walls 3.3 that are inclined upwards from middle to two ends are arranged on the lower end of the protective door 3, a fulcrum 6 for vertical swing of the protective door 3 is formed at the intersection of the two bottom inclined walls 3.3, in fact, the fulcrum 6 formed is an intersection line extending along the width direction of the protective door 3 because the fulcrum 6 is formed by the intersection of the two bottom inclined walls 3.3, this intersection line is regularly known as linear shaft among those skilled in this art, and naturally, in order to obtain smoother intersection of the two bottom inclined walls 3.3, the two bottom inclined walls 3.3 can be intersected in a manner of circular arc transition, which is regarded as an improvement of this embodiment, in this way, the fulcrum 6 formed is an arc-shaped shaft (it is known as arc-shaped shaft since its cross section is arc-shaped) extending along the width direction of the protective door 3. Limiting lug bosses 3.4 matched with the jacks on the protective door casing 4 are also arranged on the left and right lower ends of the protective door 3, respectively, when a single pin is inserted into the jack at the left end of the socket panel 1, the limiting lug boss on the left lower end of the protective door 3 will be limited on the left sidewall of the jack on the left end of the protective door casing 4, similarly, when a single pin is inserted into the jack at the right end of the socket panel 1, the limiting lug boss on the right lower end of the protective door 3 will be limited on the left sidewall of the jack on the right end of the protective door casing 4.

As an improvement of this embodiment, the partition 4.1 and the right inner wall of the protective door 3 are respectively provided with the installation bases 7 for the reset spring 2 to be sleeved. When the two ends of the reset spring 2 are sleeved on the installation bases 7 respectively, the locating reliability of the reset spring 2 is enhanced to prevent the reset spring 2 from springing out effectively.

As an improvement of this embodiment, the upper end of the protective door 3 is also provided with two top inclined walls 3.5 that are inclined downwards from middle to two ends, and an upper fulcrum 8 for vertical swing of the protective door 3 is formed at the intersection of the two top inclined walls 3.5.

As an improvement of this embodiment, the protective door casing 4 is further provided with a copper installation frame 4.2 for copper (not shown) installation.

For the up and down directions, the left and right directions and the front and rear directions in the first embodiment, please refer to the up and down directions, the left and right directions and the front and rear directions shown as FIG. 2.

The second embodiment of the safety socket with protective door in the invention is shown as FIG. 3 to FIG. 6, and the difference of the second embodiment from the first embodiment is that: the protective door casing 4 is further equipped with a protective door cover plate 9 for preventing the reset spring 2 from springing out in the process of assembly, the protective door cover plate 9 is located between the socket panel 1 and the protective door casing 4, and the protective door cover plate 9 is installed on an installation column 4.5 and a lug boss 4.4 of the protective door casing 4 through installation holes 9.1 at the diagonal positions and grooves 9.2 on the front and rear sidewalls. That is to say, it may be used as an independent component. In order to insert a plug in the socket, the protective door cover plate 9 is also provided with jacks (they are marked by the number 5 as they are both jacks) that are used together with the socket panel 1 and the protective door casing 4. In addition, in this embodiment, no copper installation frame 4.2 for copper installation is not arranged on the bottom wall of the protective door casing 4, in this case, the copper installation frame 4.2 is arranged on the socket bottom casing.

Figure 4:
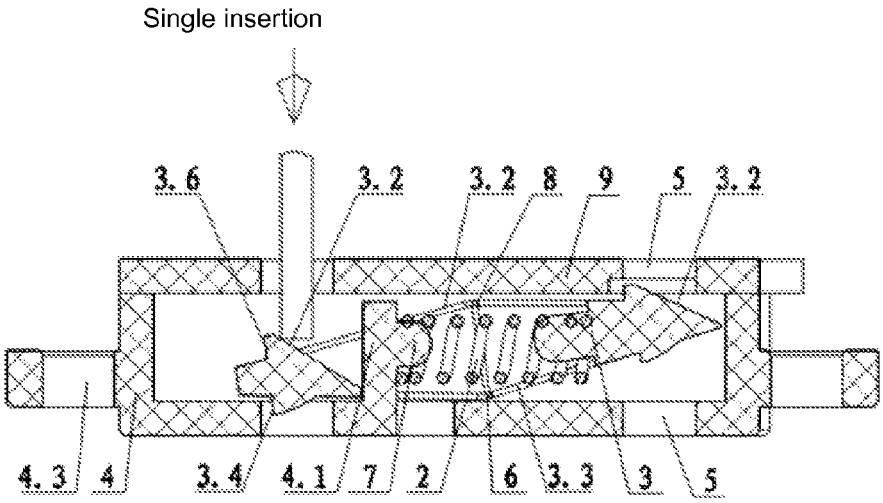
FIG. 4 is a sectional structural diagram of the second embodiment of the safety socket with protective door in the invention when a first single insertion way is adopted.

For the up and down directions, the left and right directions and the front and rear directions in the second embodiment, please refer to the up and down directions, the left and right directions and the front and rear directions shown as FIG. 4.

Referring to FIG. 4, brief description is made to the single insertion process: when a single pin is inserted into the jack at the left end of the protective door cover plate 9, the pin squeezes the slope at the left inner wall of the protective door 3 downwards, at this moment, the protective door rotates about the fulcrums 6 and 8, so under the squeezing of this pin, the protective door 3 will swing in such a manner that its left end is downward and its right end is upward, until the limiting lug boss 3.4 at the left lower end of the protective door 3 is embedded into the jack on the left end of the protective door casing 4, and simultaneously, the upper limiting lug boss 3.6 at the right upper end of the protective door 3 is embedded into the jack on the right end of the protective door cover plate 9, thus the insertion of single pin is effectively prevented. And when the pin is pulled out of the jack at the left end of the protective door cover plate 9, force application of the protective door disappears, balance is regained on the two sides of the protective door, as a result, the protective door returns to its original position and is under a free state so as to shade the jacks, which effectively prevents the copper (not shown) in the socket from exposure.

Figure 5:
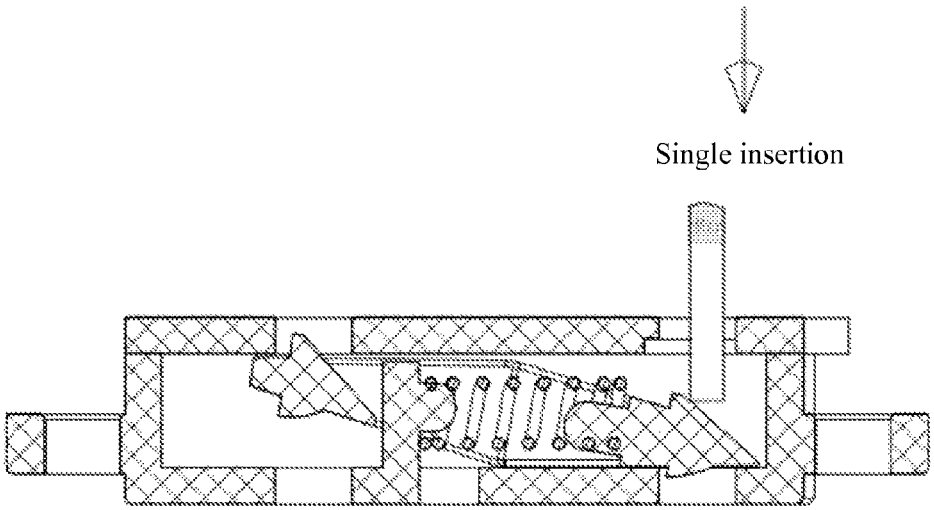
FIG. 5 is a sectional structural diagram of the second embodiment of the safety socket with protective door in the invention when a second single insertion way is adopted.
Figure 6:
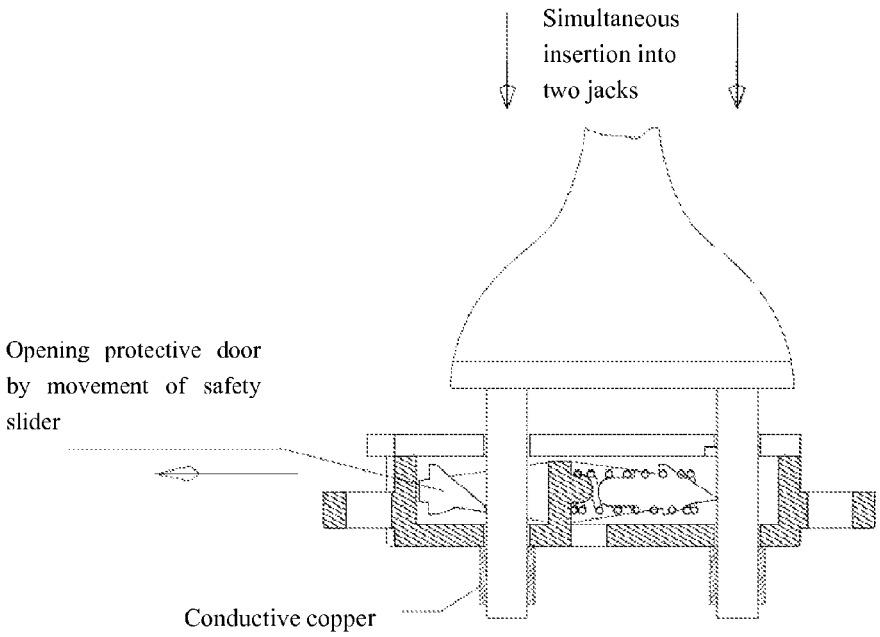
FIG. 6 is a sectional structural diagram of the second embodiment of the safety socket with protective door in the invention when pins are inserted into both jacks.

Referring to FIG. 5, for its single insertion process, refer to the process shown as FIG. 6, and no detailed description is made herein as they are the same in process and principle.

Referring to FIG. 6, brief description is made to the insertion process of pins into both jacks: when pins are inserted into every jack uniformly and evenly, i.e. a plug is inserted, the slopes on the left and right inner walls of the protective door 3 are evenly stressed since the slopes coming into contact with the protective door 3 have the same grade of slope and the pins have the same length, and the protective door 3 moves to the left gradually under the squeezing of the pins until the pins are inserted into the jacks of the protective door casing 4 and then come into contact with coppers to realize electric conduction. During unplugging, the pins move upwards in parallel and are separated from the protective door 3, so the protective door returns to its original position under the action of the elastic force of the spring and then shades the jacks again.

The invention claimed is:

1. A safety socket with a protective door, comprising a socket panel (1), a reset spring (2), a protective door (3), and a protective door casing (4) installed on the socket panel (1), the socket panel (1) and the protective door casing (4) being provided with jacks (5) that are used together therewith, characterized in that: a partition (4.1) is arranged inside the protective door casing (4), the protective door (3) is provided with a through cavity (3.1) and sleeved on the partition (4.1), the reset spring (2) is located in the through cavity (3.1), one end of the reset spring abuts against the partition (4.1) while the other end of the reset spring abuts against the right inner wall of the protective door (3), slopes (3.2) for the insertion of a plug are arranged on the left and right inner walls of the protective door (3), two bottom inclined walls (3.3) that are inclined upwards from middle to two ends are arranged on the lower end of the protective door (3), a fulcrum (6) for vertical swing of the protective door (3) is formed at the intersection of the two bottom inclined walls (3.3), and limiting lug bosses (3.4) matched with the jacks on the protective door casing (4) are arranged on the left and right lower ends of the protective door (3), respectively.

2. The safety socket with a protective door according to claim 1, characterized in that: the partition (4.1) and the right inner wall of the protective door (3) are respectively provided with installation bases (7) for the reset spring (2) to be sleeved.

3. The safety socket with a protective door according to claim 1, characterized in that: the upper end of the protective door (3) is also provided with two top inclined walls (3.5) that are inclined downwards from middle to two ends, and an upper fulcrum (8) for vertical swing of the protective door (3) is formed at the intersection of the two top inclined walls (3.5).

4. The safety socket with a protective door according to claim 1, characterized in that: the left and right upper ends of the protective door (3) are respectively provided with upper limiting lug bosses (3.6) matched with the jacks on the socket panel (1).

5. The safety socket with a protective door according to claim 1, characterized in that: the protective door casing (4) is further provided with a copper installation frame (4.2) for copper installation.

6. The safety socket with a protective door according to claim 1, characterized in that: the protective door casing (4) is further equipped with a protective door cover plate (9) for preventing the reset spring (2) from springing out in the process of assembly, and the protective door cover plate (9) is also provided with jacks that are used together with the socket panel (1) and the protective door casing (4).

* * * * *